US006718585B2

(12) United States Patent
McIntosh et al.

(10) Patent No.: US 6,718,585 B2
(45) **Date of Patent: *Apr. 13, 2004**

(54) FOLDING MULTI-TOOL WITH ADJUSTABLE PLIERS

(75) Inventors: Herman J. McIntosh, Jacksonville, AL (US); Ken E. Griffey, Jacksonville, AL (US); Greg Cook, Jacksonville, AL (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/218,848

(22) Filed: Aug. 13, 2002

(65) Prior Publication Data

US 2002/0184714 A1 Dec. 12, 2002

Related U.S. Application Data

(63) Continuation of application No. 09/859,344, filed on May 16, 2001, now Pat. No. 6,430,768, which is a continuation of application No. 09/204,432, filed on Dec. 3, 1998, now abandoned, which is a continuation of application No. 08/784,941, filed on Jan. 16, 1997, now Pat. No. 6,047,426, which is a continuation-in-part of application No. 08/609,975, filed on Feb. 29, 1996, now Pat. No. 5,697,114.

(51) Int. Cl.[7] ..... B25B 7/22

(52) U.S. Cl. ..... 7/128; 7/129; 30/162; 81/418

(58) Field of Search ..... 7/128, 129, 167; 30/152, 162; 81/300, 415, 416, 418, 427.5

(56) References Cited

U.S. PATENT DOCUMENTS

| | | | |
|---|---|---|---|
| 337,858 | A | 3/1886 | Neuhaus |
| 358,312 | A | 2/1887 | Weck |
| 445,509 | A | 1/1891 | Thayer |
| 580,235 | A | 4/1897 | Strum |
| 592,766 | A | 11/1897 | Effinger et al. |
| 762,725 | A | 6/1904 | Kaufman |

(List continued on next page.)

FOREIGN PATENT DOCUMENTS

| | | |
|---|---|---|
| DE | 103496 | 8/1991 |
| WO | WO 98/18599 | 5/1998 |

OTHER PUBLICATIONS

*Blade*, Jul. 1996, p. 42, ad for Gerber Legendary Blades, multi–plier tool.

Unknown publication, Summer 1996, p. 18, ad for Gerber Multi–Plier Pocket Tool Kit.

*Outdoor Retailer Magazine*, Unknown publication date, ad for Gerber Multi–Plier Tool.

(List continued on next page.)

*Primary Examiner*—James G. Smith
(74) *Attorney, Agent, or Firm*—Chernoff, Vilhauer, McClung & Stenzel, LLP

(57) ABSTRACT

A folding multi-tool comprising first and second generally channel-shaped handles each having first and second ends, each generally channel-shaped handle having an open side and an at least partly closed side opposite the open side, the at least partly closed sides comprising plier-receiving openings. The folding multi-tool also includes pliers including first and second plier halves pivotally and adjustably mounted to each other, with the plier halves being pivotally mounted between flanges at the first ends of the handles. Control straps extend between the flanges for limiting the maximum pivotal movement of the plier halves and for frictionally resisting pivotal movement of the plier halves. The folding multi-tool is foldable between a closed, compact configuration and an opened, extended configuration for operating the pliers and in the opened, extended configuration the open sides of the handles face each other.

5 Claims, 7 Drawing Sheets

U.S. PATENT DOCUMENTS

| | | | | |
|---|---|---|---|---|
| 858,003 | A | 6/1907 | Klever | |
| 881,294 | A | 3/1908 | Billings | |
| 1,174,132 | A | 3/1916 | Dragun | |
| 1,187,842 | A | 6/1916 | Kaas | |
| 1,334,425 | A | 3/1920 | Wernimont | |
| 1,370,906 | A | 3/1921 | Newton | |
| 1,467,661 | A | 9/1923 | Undy | |
| 1,472,826 | A | 11/1923 | Champlin | |
| 1,474,592 | A | 11/1923 | Jacoby | |
| 1,486,725 | A | 3/1924 | Brown | |
| 1,524,694 | A | 2/1925 | Di Maio | |
| 1,551,328 | A | 8/1925 | Perry | |
| 1,561,833 | A | 11/1925 | Cruickshank | |
| 1,691,181 | A | 11/1928 | Coats et al. | |
| 1,902,913 | A | 3/1933 | Sievern | |
| 2,205,717 | A | 6/1940 | Fedon | |
| 2,514,130 | A | 7/1950 | Jones | |
| 2,561,682 | A | 7/1951 | Barnett | |
| 2,575,652 | A | 11/1951 | Bovee | |
| 2,641,149 | A | 6/1953 | Petersen | |
| 2,747,446 | A | 5/1956 | Eder | |
| 3,044,081 | A | 7/1962 | Robinson, Jr. | |
| 4,238,862 | A | 12/1980 | Leatherman | |
| 4,512,051 | A | 4/1985 | Magan | |
| 4,555,822 | A | 12/1985 | Miceli | |
| 4,563,833 | A | 1/1986 | Aucoin | |
| 4,648,145 | A | 3/1987 | Miceli | |
| 4,669,140 | A | 6/1987 | Miceli | |
| 4,744,272 | A | 5/1988 | Leatherman | |
| 4,888,869 | A | 12/1989 | Leatherman | |
| 4,995,128 | A | 2/1991 | Montgomery et al. | |
| 5,014,379 | A | 5/1991 | Hull et al. | |
| 5,029,355 | A | 7/1991 | Thai | |
| 5,062,173 | A | 11/1991 | Collins et al. | |
| 5,142,721 | A | 9/1992 | Sessions et al. | |
| 5,207,012 | A | 5/1993 | Lael | |
| 5,212,844 | A | 5/1993 | Sessions et al. | |
| D338,386 | S | 8/1993 | Frazer | |
| 5,245,721 | A | 9/1993 | Lowe et al. | |
| 5,267,366 | A | 12/1993 | Frazer | |
| 5,697,114 | A | 12/1997 | McIntosh et al. | |
| 5,765,247 | A | 6/1998 | Seber et al. | 7/128 |
| 6,047,426 | A | 4/2000 | McIntosh et al. | |
| 6,233,769 | B1 | 5/2001 | Seber et al. | 7/128 |
| 6,430,768 | B2 | 8/2002 | McIntosh et al. | 7/129 |

OTHER PUBLICATIONS

Unknown publication, Summer 1996, p. 21, ad for SOG Power Piler.

*Blade*, Unknown publication date, p. 38, ad for Power Plier from SOG Specialty Knives Inc.

*Blade*, Jul. 1996, p. 3, ad for Buck Knives, Bucktool.

*Blade*, Unknown publication date, p. 66, ad for Multimaster by Kutmaster.

Bear MGC, 1996 Product Catalog.

E–Bay Advertisement, "Early 1900s Folding Fisherman's Tool MT," Item No. 2153119094, at least as early as Jan. 13, 2003.

FOLDING MULTI-TOOL WITH ADJUSTABLE PLIERS

CROSS-REFERENCE TO RELATED APPLICATION

This application is a continuation of application Ser. No. 09/859,344, filed May 16, 2001, now U.S. Pat. No. 6,430, 768, which is a continuation of application Ser. No. 09/204, 432above, filed Dec. 3, 1998, which is a continuation of application Ser. No. 08/784,941, filed Jan. 16, 1997, now U.S. Pat. No. 6,047,426, which is a continuation-in-part of application Ser. No. 08/609,975, filed Feb. 29, 1996, now U.S. Pat. No. 5,697,114.

TECHNICAL FIELD

The present invention relates generally to a multi-function pocket tool which includes adjustable pliers and other selected tools.

BACKGROUND OF THE INVENTION

Multi-function tools are well known. In typical multi-function tools, pliers and other selected tools, such as screwdrivers, knife blades, files, etc., are provided in a single tool. Known multi-function tools often include pliers and have channel-shaped handles pivotally connected to the tangs of the pliers. The handles fold over so that the pliers are received in the channel-shaped handles. Also, the other tools fold over and are received in the channel-shaped handles as well.

One disadvantage of such known arrangements is that when using the pliers of the tool, the open sides of the channel-shaped handles face outwardly, away from one another. When gripping the tool tightly to secure an object with the plier jaws, the open sides of the channel-shaped handles can become uncomfortable and can limit the amount of gripping force comfortably applied by the user.

U.S. Pat. No. 4,744,272 of Leatherman relates to a foldable tool and discloses the use of handle extensions which can be folded over to provide a broad smooth surface to be grasped and squeezed by the user's hand. This also has the effect of lengthening the tool, thereby making it less compact in operation U.S. Pat. No 5,142,721 of Sessions. et al. relates to a pocket tool with retractable jaws and describes another approach to addressing this need for comfortable plier handles. The pocket tool disclosed in Sessions. et al. includes a pair of retractable jaws which slide into and out of the channel-shaped handles. This tends to add to the complexity of the tool and somewhat reduces the strength of the pliers.

Another disadvantage of such known arrangements is that to deploy an individual tool for use, the multi-function tool handles must be opened, the individual tool selected and opened, and the multi-function tool handles closed. This is somewhat cumbersome and slow.

Accordingly, it can be seen that a need remains in the art for a folding multi-tool with pliers which, when the pliers are in use, provides a smooth handgrip. A need also remains for a folding multi-tool in which the individual tools can be easily and quickly deployed for use. It is to the provision of such a folding multi-tool that the present invention is primarily directed.

SUMMARY OF THE INVENTION

Briefly described, in a first preferred form the present invention comprises a folding multi-tool with first and second generally channel-shaped handles. The handles each have first and second ends and an open side and an at least partly closed side opposite the open side. The at least partly closed sides include openings for receiving pliers. The folding multi-tool also includes pliers comprising first and second plier halves pivotally mounted to each other, with the plier halves also being pivotally mounted to the first ends of the handles. Also, the folding multi-tool is foldable between a closed, compact configuration and an opened, extended configuration for operating the pliers. In the opened, extended configuration, the open sides of the handles face each other.

Preferably, the folding multi-tool includes, in each of the handles, at least one tool pivotally mounted to the second ends for pivotal movement between a closed position and an opened position, with the tools being received in the open sides of the handles. Preferably, the individual tools can be moved from the closed positions to the opened positions while the folding multi-tool is in its closed, compact configuration. Also preferably, the partly closed sides of the folding multi-tool are provided with rounded edges for greater comfort.

Preferably, the folding multi-tool includes first and second control straps for limiting the maximum pivotal movement of the plier halves relative to the plier handles and for frictionally resisting pivotal movement of the pliers. Preferably, the plier halves each include an eccentric tang and the tangs are mounted between flanges. The eccentric tangs engage the control straps and provide greater frictional resistance to pivotal movement of the pliers with the multi-tool in the opened, extended configuration than in the closed, compact configuration. This allows the multi-tool to be easily opened, while at the same time helps to maintain the multi-tool in the opened, extended configuration once opened.

In a second preferred form the present invention comprises a folding multi-tool with first and second generally channel-shaped handles. The handles each have first and second ends and an open side and an at least partly closed side opposite the open side. The at least partly closed sides include openings for receiving pliers. The folding multi-tool also includes pliers comprising first and second plier halves pivotally and adjustably mounted to each other, the plier halves being adjustably movable between a compact, first position for grasping small items and an expanded, second position for grasping larger items. The plier halves also are pivotally mounted to the first ends of the handles. Also, the folding multi-tool is foldable between a closed, compact configuration and an opened, extended configuration for operating the pliers. In the opened, extended configuration, the open sides of the handles face each other.

The folding multi-tool according to the invention is very comfortable to use, is extremely compact, is simple in its construction, and durable in use. The folding multi-tool according to the invention also results in widely adaptable, strong, stable pliers, which are comfortably gripped, allowing the user to apply great force thereto. Conveniently, the invention also allows the individual tools (other than the pliers) to be used from the closed, compact configuration without opening the entire folding multi-tool.

Accordingly, it is an object of the present invention to provide a folding multi-tool with pliers and comfortable hand grips.

It is another object of the present invention to provide a folding multi-tool which allows great gripping force to be applied to the pliers of the handle comfortably.

It is another object of the present invention to provide a folding multi-tool with pliers which is relatively compact when the pliers are in use.

It is another object of the present invention to provide a folding multi-tool with strong, stable pliers.

It is another object of the present invention to provide a folding multi-tool with a plurality of individual tools which can be deployed without opening the entire multi-tool.

It is another object of the present invention to provide a folding multi-tool with a plurality of individual tools which can be easily and quickly deployed.

It is another object of the present invention to provide a folding multi-tool with adjustable pliers.

These and other objects, advantages, and features of the present invention will become apparent upon reading the following specification in conjunction with the accompanying drawing figures.

BRIEF DESCRIPTION OF THE DRAWING FIGURES

DETAILED DESCRIPTION OF THE PREFERRED EMBODIMENTS

Figure 1:
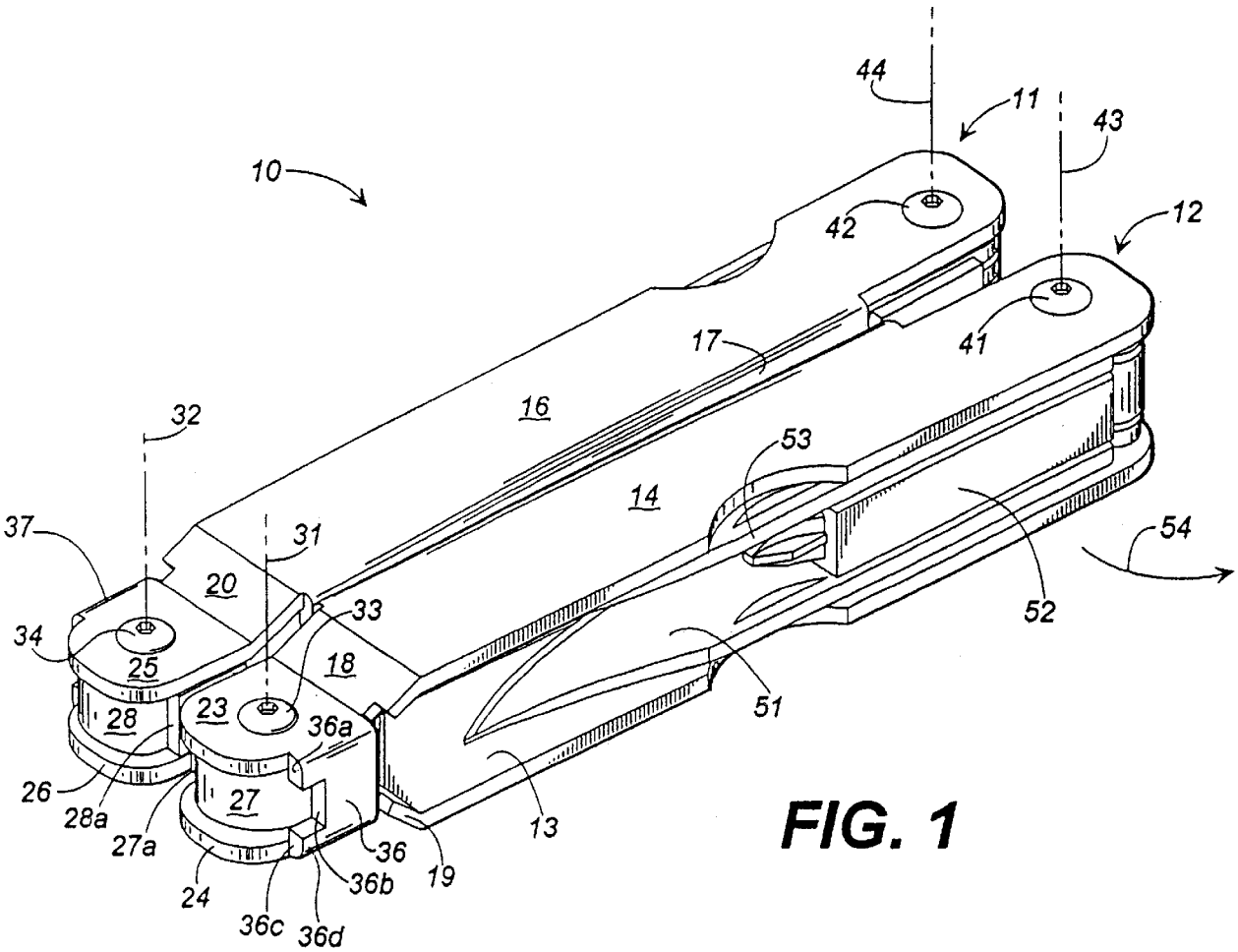
FIG. 1 is a perspective illustration of a folding multi-tool in a first preferred form of the invention, shown in a closed, compact configuration.

Referring now to the drawing figures, wherein like reference numerals represent like parts throughout the several views, FIG. 1 shows a folding multi-tool 10 according to a preferred form of the invention. The folding multi-tool 10 depicted in FIG. 1 is shown in a closed, compact configuration, such as would be used for storing the tool in a sheath. The folding multi-tool 10 includes first and second channel-shaped handles 11 and 12.

Each of the channel-shaped handles 11 and 12 is generally "C"-shaped in cross-section and includes an upper wall, a lower wall, and a vertically extending wall between the upper and lower walls. For example, handle 12 includes lower wall 13 and upper wall 14 and an unshown (at least in FIG. 1) vertical wall extending therebetween. Likewise, channel-shaped handle 11 includes an upper wall 16, an unshown lower wall, and a vertical wall 17 extending therebetween.

The channel-shaped handles include integral shoulders, such as shoulders 18, 19, and 20. The shoulders extend at an angle between the upper and lower walls of the handles and flange portions, such as flanges 23–26. Plier tangs 27 and 28 are positioned between the flanges 23 and 24, and 25 and 26 (the pliers will be described in more detail in connection with subsequent figures). The plier tangs 27 and 28 are mounted between the flanges for pivotal movement about pivot axes 31 and 32. The plier tangs 27 and 28 are secured in place by combination bolt/pivot pins 33 and 34 which extend through the upper flanges 23 and 25, through the plier tangs 27 and 28, and are threadedly received in the lower flanges 24 and 26 The bolts/pivot pins 33 and 34, along with the upper and lower flanges, constrain the movement of plier tangs 27 and 28 to pivotal movement about the pivot axes 31 and 32.

Extending between the upper and lower flanges are a pair of plier stops 36 and 37 for limiting the pivotal motion of the plier tangs. The plier stops 36 and 37 each include three vertical surfaces or shoulders, such as surfaces 36*a*, 36*b*, and 36*c*. The plier stops are generally "C"-shaped and include upper and lower flanges, such as lower flange 36*d*. The plier tangs 27 and 28 include tabs 27*a* and 28*a* which engage the plier stops 36 and 37, fitting between the upper and lower flanges of the plier stops and being limited in travel by the shoulders, such as shoulder 36*b*.

Figure 4A:
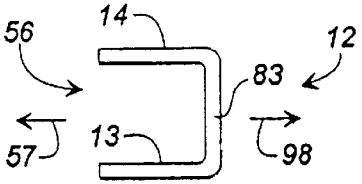
FIG. 4A is a sectional view of the folding multi-tool of FIG. 4 taken along the lines of 4A—4A, with some elements omitted for clarity.
Figure 4:
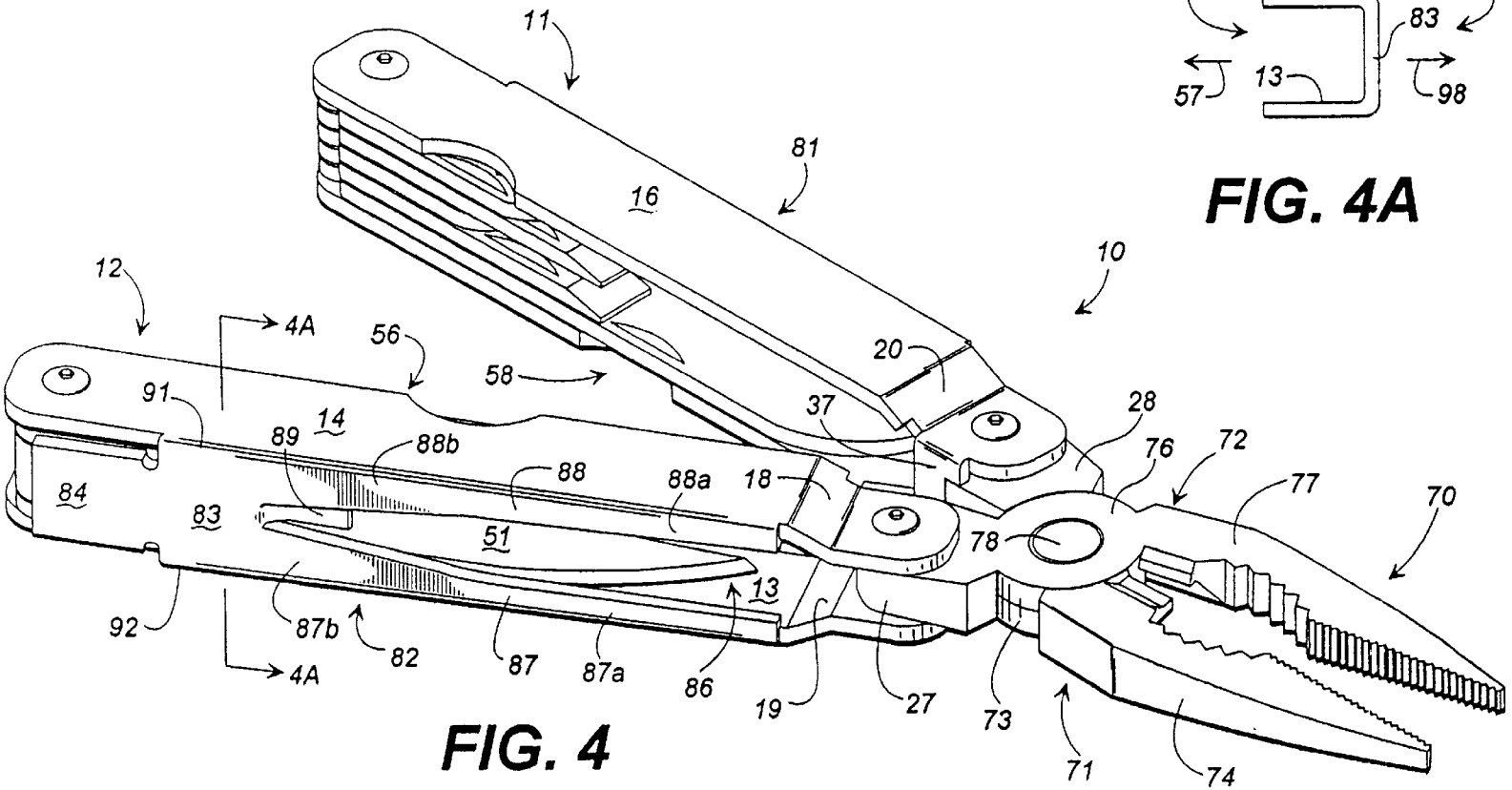
FIG. 4 is a perspective illustration of the folding multi-tool of FIG. 1, shown in a fully opened, extended configuration.

The tangs 27, 28 are eccentric and eccentrically contact an interior surface of the plier stops 36, 37 such that when the folding multi-tool 10 is in the folded, compact configuration shown in FIG. 1, the plier stops provide a modest frictional resistance to the pivotal movement of the plier tangs 27, 28, while in the unfolded, opened configuration shown in FIG. 4, the plier stops provide a greater frictional resistance to pivotal movement of the plier tangs. This allows the folding multi-tool to be opened easily and quickly, while also helping to hold the pliers in place when the folding multi-tool is in the extended configuration of FIG. 4 (making the pliers easier to use).

At the end of the handles 11 and 12 opposite the location of the plier tangs 26 and 27 a second pair of combination bolts/pivot pins is provided, in particular bolts/pivot pins 41 and 42. These bolts/pivot pins extend through the upper walls 14 and 16 of the handles and through numerous individual tools received in the channel-shaped handles, to the lower walls of the handles. Thus, the bolts/pivot pins 41 and 42 act as pivot axles to constrain movement of the various tools to pivotal motion about pivot axes 43 and 44.

A number of tools are pivotally received in the open sides of the handles 11 and 12 and are pivoted about the pivot axes 43 and 44. For example, in the illustrative embodiment shown in FIG. 1, handle 12 includes a knife 51, a Phillips screwdriver 52, and a file 53. As can be seen in FIG. 1, these tools are received in the open side of the channel-shaped handles and open outwardly therefrom. For example, the knife, Phillips screwdriver, or file 51–53 can be deployed by rotating each in the direction of direction arrow 54 to swing them outwardly from the open side of the channel-shaped handle 12. This arrangement advantageously allows the tools to be deployed from the closed, compact configuration of the folding multi-tool overall, a significant convenience. For example, in the known prior art, in order to deploy the typical tools, one must move the handles apart from one another, and then pull the individual tool out, and then close up the handles again in order to use a selected tool. By stark contrast, the present invention allows the user to select, deploy and use an individual tool without opening up the multi-tool overall.

Figures 2, 3:
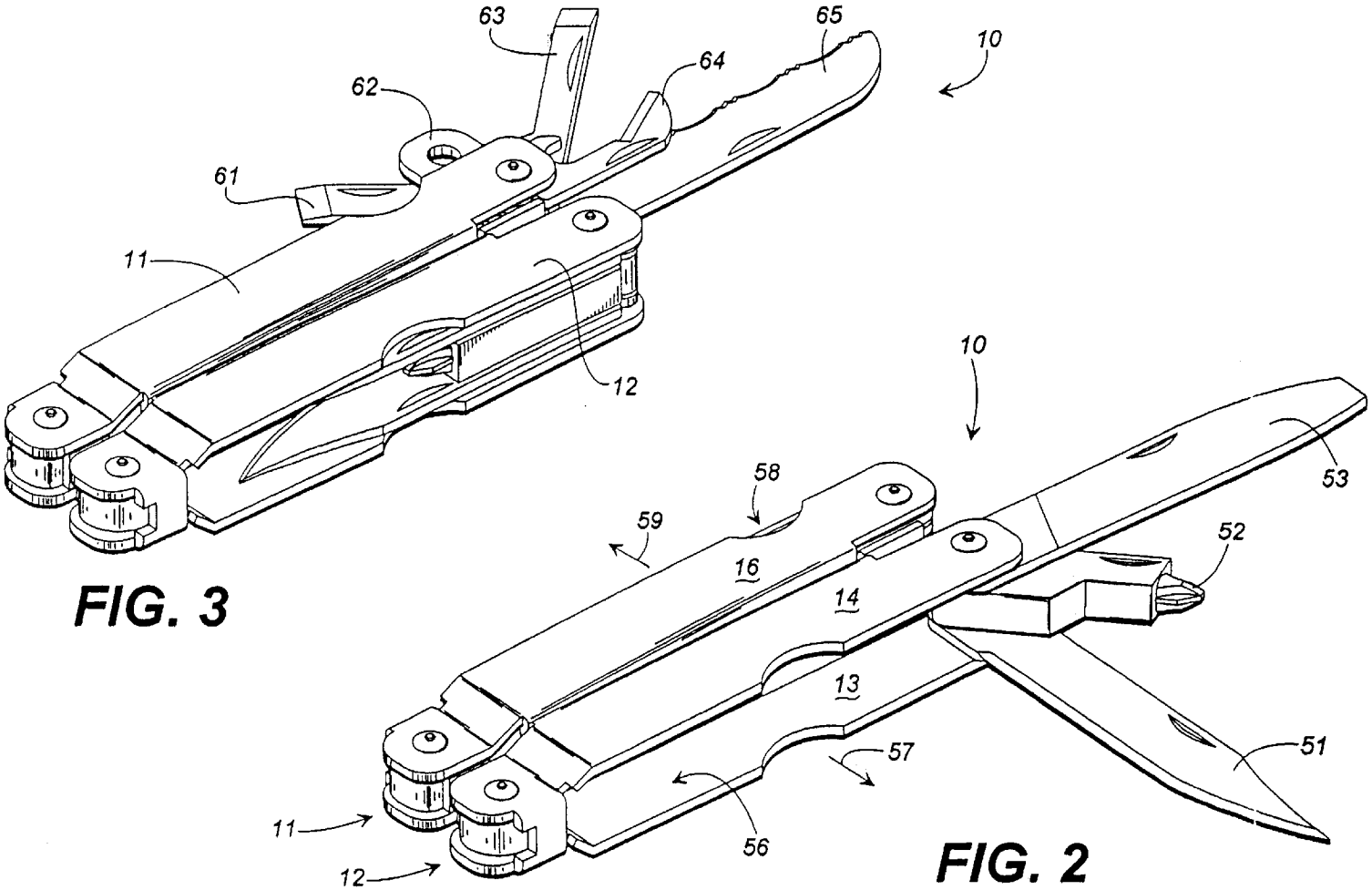
FIG. 2 is a perspective illustration of the folding multi-tool of FIG. 1, shown with some tools thereof deployed.
FIG. 3 is a perspective illustration of the folding multi-tool of FIG. 1, shown with some other tools thereof deployed.

FIGS. 2 and 3 show how the individual tools can be easily and quickly deployed without opening up the entire multi-tool. For example, in FIG. 2 the folding multi-tool 10 is shown in its closed, compact configuration with the open sides of the channel-shaped handles 11 and 12 facing away from each other. For example, as shown in FIG. 2, the channel-shaped handle 12 has an open side 56 which generally points in the direction of direction arrow 57. Likewise, channel-shaped handle 11 has an open side 58 which points in the direction of direction arrows 59, which is opposite to direction arrow 57. With this construction, the individual tools, such as knife 51, the Phillips screwdriver 52, and the file 53 can be quickly and easily deployed, without opening up the entire folding multi-tool 10.

FIG. 3 shows the deployment of other individual tools, including straight screwdriver 61, lanyard loop 62, larger straight screwdriver 63, a combination can opener and bottle opener 64, and a serrated knife 65.

Referring now to FIG. 4, the folding multi-tool 10 is shown in its open, extended configuration for using the pliers. The folding multi-tool 10 includes pliers 70 having a first plier half 71 and a second plier half 72. First plier half 71 includes tang 28, a lower platen 73 and plier jaw 74. Similarly, second plier half 72 includes plier tang 27, upper platen 76, and plier jaw 77. A large pivot pin 78 extends through the upper and lower platens and secures them to one another and acts as a pivot axle to allow the first and second plier halves 71 and 72 to be pivoted relative to each other. As can be seen in this figure, the plier stops, such as plier stop 37, limit the pivotal movement of the tangs 27 and 28 to allow the handles 11 and 12 to operate the pliers.

As previously described, the handles 11 and 12 include open sides 56 and 58. The handles 11 and 12 also include partly closed sides 81 and 82. Each of the partly closed sides includes a vertical wall, such as vertical wall 83 of handle 12 (shown in FIG. 4) or vertical wall 17 shown in FIG. 1. These vertical walls extend between the upper and lower sides of the handles, such as upper and lower sides 13 and 14 of handle 12. The vertical walls include a tool stop and tool keeper, such as stop and keeper 84 shown in FIG. 4. The tool stop and keeper 84 is not connected to the upper and lower sides 13 and 14, but rather extends from an end of vertical wall 83. Where the tool stop and keeper 84 adjoins to the remainder of the vertical wall 83, radiused corners are cut out in order to avoid stress spikes which would otherwise lead to a fatigue fracture over repeated uses of the tools. This is so because the tools, as they are opened, cause a slight deflection of the tool stop 84. In this way, the tool stop provides a frictional resistance to pivotal movement of the individual tools. Handle 11 includes a similar tool stop.

The vertical wall 83 also includes a plier opening 86 defined by a lower face strip 87 and an upper face strip 88. The lower face strip 87 includes a straight section 87*a* and a tapered section 87*b*. Likewise, the upper strip 88 includes a straight section 88*a* and a tapered section 88*b*. Together, the straight sections 87*a* and 88*a* define a straight portion of the opening 86, while the tapered portions 87*b* and 88*b* of the strips define a tapered portion of the opening 86. At the end of the tapered opening, a guide tab or plier jaw stop 89 is attached to the vertical wall 83 and limits the travel of the plier jaw into the opening 86 to prevent the plier jaw from contacting the tools inside the handle.

At the interface between the upper wall 14 and the vertical wall 83, the edge 91 therebetween is rounded, preferably with a radius of between about 5⁄64 and 7⁄64 of an inch, most preferably 3⁄32 of an inch. Likewise, the lower edge 92 has a similar radius, as do the corresponding edges on handle 11.

FIG. 4A shows a sectional view of plier handle 12 (with the individual tools removed for clarity). The channel-shaped handle 12 has an open side 56 and partly closed side comprising the vertical wall 83 (which includes the unshown opening for receiving the plier half). The individual tools open by moving in the direction of direction arrow 57, while the pliers open from the opposite side in the direction of direction arrow 58. Thus, the individual tools and the pliers open from opposite sides of the handle 12. Handle 11 is similarly constructed.

Figure 5:
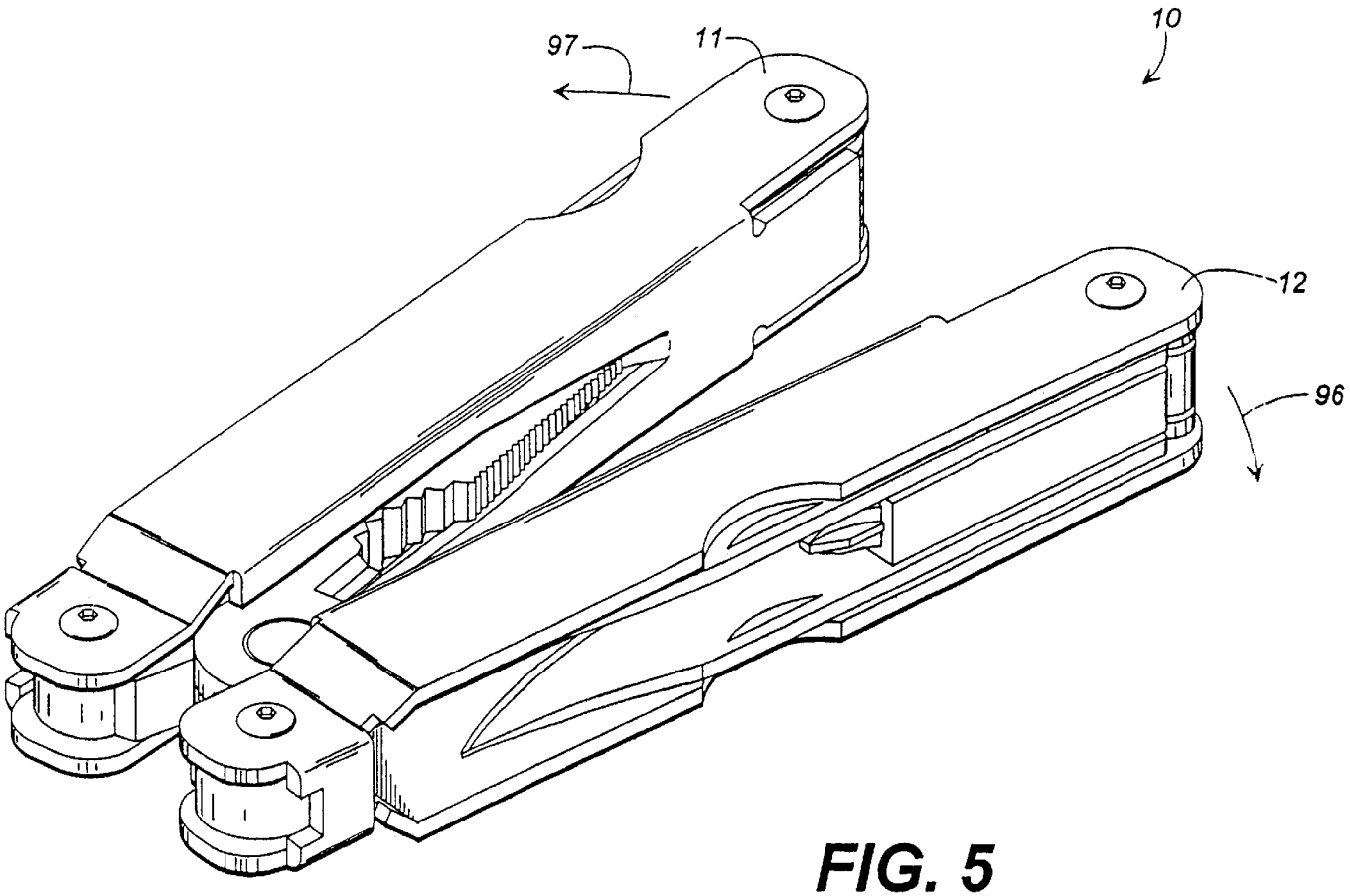
FIG. 5 is a perspective illustration of the folding multi-tool of FIG. 1, shown in a slightly opened configuration.
Figure 6:
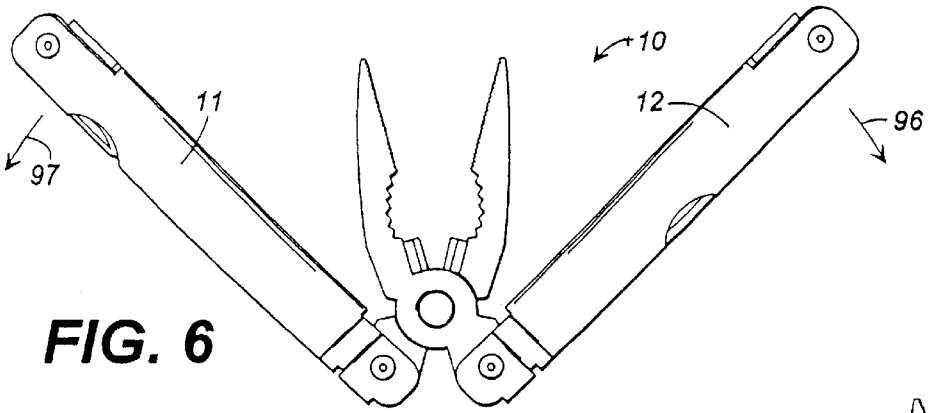
FIG. 6 is a perspective illustration of the folding multi-tool of FIG. 1, shown in a moderately opened configuration.
Figure 7:
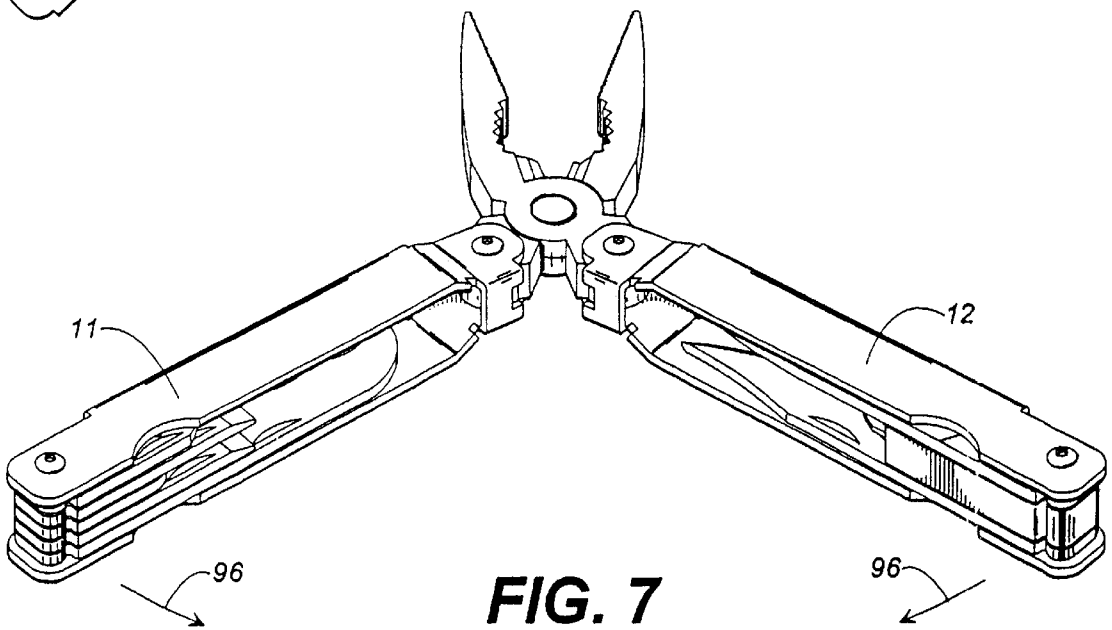
FIG. 7 is perspective illustration of the folding multi-tool of FIG. 1, shown in a substantially opened configuration.

To operate the folding multi-tool to use the pliers, one starts with the folding multi-tool 10 in the configuration shown in FIG. 1 (a closed, compact configuration). The handles are then spread apart, with the pliers acting as a pivot point to achieve the slightly opened configuration of FIG. 5. The plier handles 11 and 12 are moved further in the direction of direction arrows 96 and 97 (away from one another) to obtain the moderately opened configuration of FIG. 6. The handles are moved further in the direction of direction arrows 96 and 97 to achieve the substantially opened, but not quite fully opened, configuration of FIG. 7. The handles are brought even more towards each other in the direction of direction arrows 96 and 97 to achieve the fully opened, extended configuration shown in FIG. 4.

This construction has numerous advantages. For example, the individual tools can be deployed without opening the entire multi-tool. Also, these individual tools can be easily and quickly deployed. Moreover, with the multi-tool in the opened, extended configuration shown in FIG. 4, the handles 11 and 12 are quite comfortable owing to the fact that the portions of the handles contacting the user's hands are at least partly closed (rather than the open side containing the individual tools), thereby providing a more even distribution of the gripping force over the user's hand. Also, the use of the rounded edges (e.g., 91, 92) makes for a more comfortable grip as well. This more comfortable grip allows greater gripping force to be applied comfortably to the handles, making the pliers more useful as a useful working tool. This construction also allows the multi-tool to be rather compact when using the pliers, while still providing excellent comfort. It also has the advantage that the pliers are rather strong and stable, enabling the pliers to do substantial work. Another advantage of this construction is that the construction of the multi-tool is an elegantly simple solution to the problem of providing comfortable hand grips for the pliers, making the multi-tool durable and easily constructed. Also, the eccentric tangs of the pliers engaging the plier stops eccentrically allow the multi-tool to be easily opened and help to stabilize the pliers once in the extended, open configuration.

Figure 8:
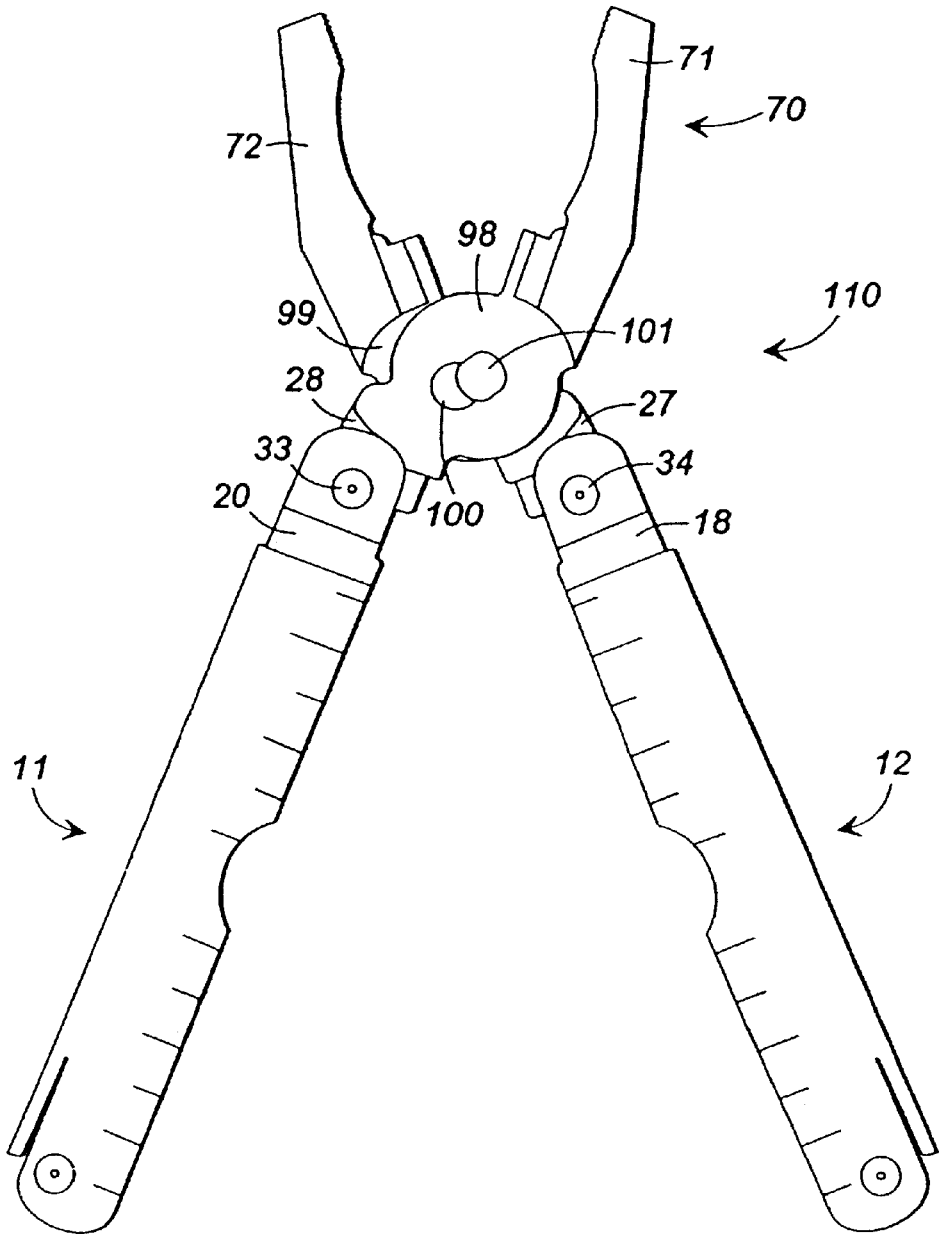
FIG. 8 is a plan view of a folding: multi-tool in a second preferred form of the invention, shown in an opened configuration with some elements omitted for clarity.
Figure 9:
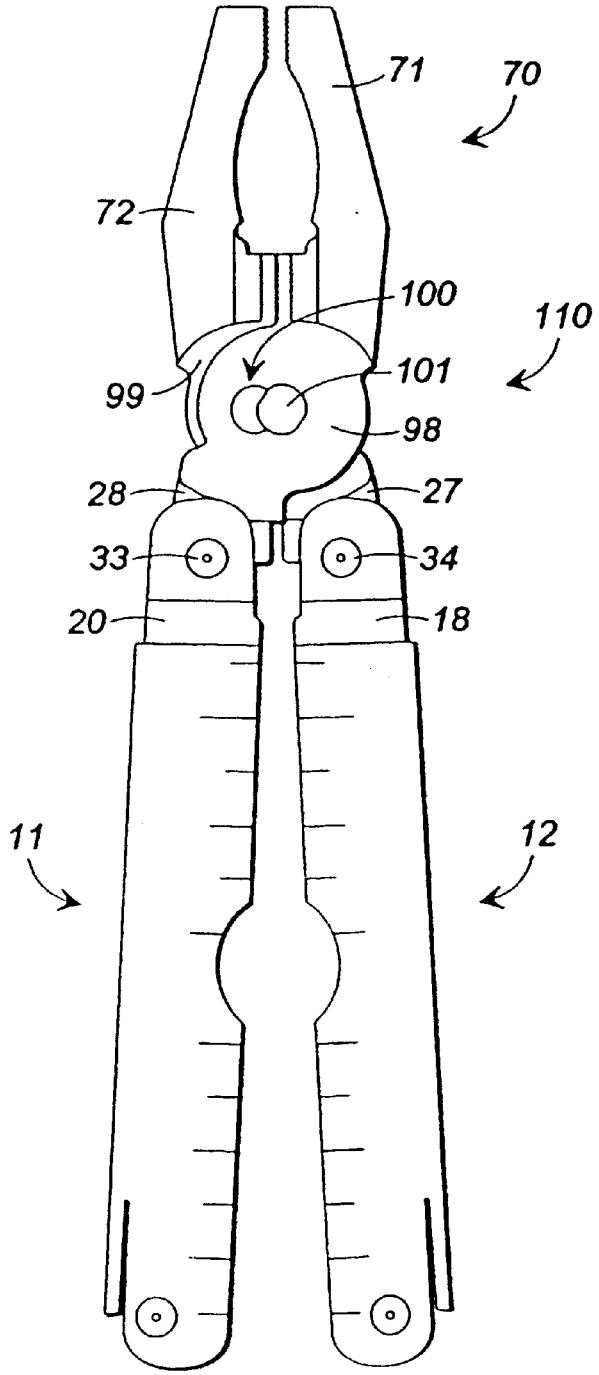
FIG. 9 is a plan view of the folding multi-tool of FIG. 8 in an opened configuration with the plier jaws closed, with some elements omitted for clarity.

Referring now to FIGS. 8, 9, and 10, a second preferred form of the invention is shown. Specifically, a second form of the folding multi-tool 110 is shown in FIG. 8 in an overall open configuration, with the pliers 70 in an open configuration. Pliers 70 are adjustably movable between a compact, first position for grasping small items and an expanded, second position for grasping larger items. FIGS. 8 and 9 depict the compact, smaller configuration for grasping small items.

As in the first embodiment, the folding multi-tool 110 includes first and second channel-shaped handles 11 and 12.

The channel-shaped handles 11 and 12 include integral shoulders 18 and 20. Plier tangs 27 and 28 are secured in place by combination bolt/pivot pins 33 and 34. Like the first embodiment, the tools open from one side of the handles, while the pliers open from the other side of the handles.

The pliers 70 include a first plier half 71 and a second plier half 72. However, unlike the embodiment shown in FIGS. 1–7, pliers depicted-in FIGS. 8–9 are adjustable pliers as mentioned above. The adjustable pliers 70 have an upper platen 98 and a lower platen 99. The upper platen 98 defines a figure eight shaped opening 100. A pivot pin 101 is secured to the lower platen 98 and extends up through the figure eight shaped opening 100. The pivot pin includes a head (unshown) which is slightly larger than the diameter of either substantially circular part of the opening 100. In this way, the head is prevented from pulling through the figure eight shaped opening 100. Alternatively, the end of the pin can be threaded to receive a threaded nut, dispensing with the head of the pivot pin. The pin includes parallel flats ground therein and is non-rotationally mounted in the lower platen 99. The parallel flats can be seen most easily in FIG. 9.

In the compact configuration shown in FIG. 8 and in FIG. 9, the pivot pin acts as a pivot axle or fulcrum to allow pressure to be exerted by the handles on the jaws of the pliers 70, thereby allowing the pliers to effectively grip small items. The handles 11 and 12 can be manipulated toward and away from each other to open and close plier jaws, as depicted in FIGS. 8 and 9. Moreover, to increase the capacity of the plier jaws for grasping larger items, the pliers 70 can be opened to the open configuration depicted in FIG. 8 and plier half 71 can be slid laterally relative to plier half 72 to move the pivot pin 101 into the other half of the figure eight shaped opening 100. In this way, the pliers can be reconfigured for grasping larger items. In this extended or expanded configuration, the pliers nevertheless can be manipulated in the same way as that depicted in FIG. 8 and in FIG. 9 by operation of the handles to open and close pliers jaws 71 and 72.

While the invention has been disclosed in preferred forms, it will be apparent to those skilled in the art that many modifications, additions, and deletions may be made therein without departing from the spirit and scope of the invention as set forth in the following claims.

What is claimed is:

1. A folding multi-tool comprising:

a first handle having a first end and a second end, said first handle comprising an open side;

a second handle having a first end and a second end, said second handle comprising an open side;

pliers comprising first and second plier halves pivotally secured to each other, with said plier halves being pivotally mounted to said first ends of said handles;

a first tool pivotally mounted to said first handle at said second end of said first handle, said first tool being pivotally moveable between a closed position and an open position;

a second tool pivotally mounted to said second handle at said second end of said second handle, said second tool being pivotally moveable between a closed position and an open position;

wherein said folding multi-tool is foldable between a closed, compact configuration and an opened, extended configuration for operating said pliers; and wherein with said folding multi-tool in said closed, compact configuration, said open sides of said handles face away from each other in opposite directions and said first tool is movable from said closed position to said open position while said folding multi-tool remains in said closed compact configuration.

2. A folding multi-tool, said multi-tool comprising:

first and second handles each having first and second ends, at least one of said handles being generally channel-shaped and comprising an open side and an at least partly closed side opposite said open side, said at least partly closed side defining a plier-receiving opening;

pliers for grasping items and comprising first and second plier halves pivotally and adjustably mounted to each other, with said plier halves being adjustably moveable between a compact, first position for grasping small items and an expanded, second position for grasping larger items, with said plier halves being pivotally mounted to said first ends of said handles; and wherein said folding multi-tool is foldable between a closed, compact configuration and an opened, extended configuration for operating said pliers, and wherein in said opened, extended configuration said open side of said generally channel-shaped handle faces the other one of said pair of handles.

3. The folding multi-tool of claim 2, including a plier jaw stop disposed adjacent said plier-receiving opening in said partly open side of said generally channel-shaped handle.

4. The folding multi-tool of claim 3 wherein said plier jaw stop is positioned at least partially within said generally channel-shaped handle.

5. The folding multi-tool of claim 2 wherein each of said handles includes a plier jaw located so as to limit movement of said plier halves during folding of said plier halves into said handles through said openings.

* * * * *